US010000885B2

(12) United States Patent
Lee et al.

(10) Patent No.: US 10,000,885 B2
(45) Date of Patent: Jun. 19, 2018

(54) WASHING MACHINE AND WASHING METHOD THEREOF

(71) Applicant: Dongbu Daewoo Electronics Corporation, Seoul (KR)

(72) Inventors: Jae Woo Lee, Seoul (KR); Hye Ung Kim, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 606 days.

(21) Appl. No.: 14/316,101

(22) Filed: Jun. 26, 2014

(65) Prior Publication Data

US 2015/0007396 A1 Jan. 8, 2015

(30) Foreign Application Priority Data

Jul. 4, 2013 (KR) ..... 10-2013-0078300
Jul. 4, 2013 (KR) ..... 10-2013-0078302

(51) Int. Cl.
*D06F 39/08* (2006.01)
*D06F 23/04* (2006.01)
(Continued)

(52) U.S. Cl.
CPC ..... *D06F 39/088* (2013.01); *D06F 39/083* (2013.01); *D06F 23/04* (2013.01);
(Continued)

(58) Field of Classification Search
CPC ..... D06F 39/088; D06F 39/083; D06F 35/00; D06F 35/006; D06F 23/04; D06F 37/267
(Continued)

(56) References Cited

U.S. PATENT DOCUMENTS 3,248,741 A * 5/1966 Stout ..... A47K 3/064 222/78
7,627,919 B2 12/2009 Lee et al.
(Continued)

FOREIGN PATENT DOCUMENTS

CN 2723288 9/2005
CN 101892573 A 11/2010
(Continued)

OTHER PUBLICATIONS

The extended European Search Report dated Apr. 2, 2015 issued in corresponding European Patent Application No. 14002283.1.
(Continued)

*Primary Examiner* — Michael E Barr
*Assistant Examiner* — Tinsae B Ayalew

(57) ABSTRACT

Disclosed is a washing machine including an air storage unit configured to store air therein; a compression unit configured to communicate with the air storage unit and the outer tub, and to compress the air in the air storage unit by compressing water from an outer tub of the washing machine; and a water spraying tube connected to the compression unit and the tub cover. Further, the washing machine includes an opening and closing unit configured to open and close a flow path of the water spraying tube, wherein the opening and closing unit is configured to cause the water to be sprayed into an inner tub using compressed air from the air storage unit.

9 Claims, 16 Drawing Sheets

(51) Int. Cl.
*D06F 35/00* (2006.01)
*D06F 37/26* (2006.01)

(52) U.S. Cl.
CPC ..... *D06F 35/00* (2013.01); *D06F 35/006* (2013.01); *D06F 37/267* (2013.01)

(58) Field of Classification Search
USPC ..... 8/158
See application file for complete search history.

(56) References Cited

U.S. PATENT DOCUMENTS

| | | | | |
|---|---|---|---|---|
| 2010/0281927 | A1* | 11/2010 | Lee | D06F 17/04 68/200 |
| 2011/0247148 | A1* | 10/2011 | Chanda | D06F 33/02 8/137 |
| 2013/0056547 | A1* | 3/2013 | Wilson | B05B 7/1481 239/8 |
| 2014/0109620 | A1 | 8/2014 | Yoon | |

FOREIGN PATENT DOCUMENTS

| | | | |
|---|---|---|---|
| CN | 201722522 | | 1/2011 |
| CN | 102631160 | A * | 8/2012 |
| EP | 1204792 | | 5/2002 |
| EP | 1204792 | | 4/2005 |
| EP | 1700943 | | 9/2006 |
| EP | 2264240 | | 12/2010 |
| EP | 2455533 | | 5/2012 |
| JP | 2008-104541 | | 5/2008 |
| JP | 2008104541 | | 5/2008 |
| KR | 10-2014-0011305 | | 2/2004 |
| KR | 10-2004-0066612 | | 7/2004 |
| KR | 10-2011-0098488 | | 9/2011 |
| TW | 201107555 | | 3/2011 |
| WO | 2011/046358 | | 4/2011 |

OTHER PUBLICATIONS

Chinese Office Action dated Nov. 30, 2015 issued in corresponding Chinese Patent Application No. 201410312021.7 and English translation thereof.

Abstract for KR 10-2011-0098488; http://kpa.kipris.or.kr; Sep. 1, 2011.

Abstract for KR 10-2004-0066612; http://engpat.kipris.or.kr; Jul. 27, 2004.

* cited by examiner

WASHING MACHINE AND WASHING METHOD THEREOF

CROSS-REFERENCE TO RELATED APPLICATIONS

This application is based on and claims priority to Korean Patent Application Nos. 10-2013-0078300, filed on Jul. 4, 2013 and 10-2013-0078302, filed on Jul. 4, 2013, the disclosures of each of which are incorporated herein in their entireties by reference.

TECHNICAL FIELD

The present disclosure relates to a washing machine and washing method thereof and, in particular, to a washing machine and washing method capable of improving washing performance.

BACKGROUND

In general, a washing machine is an apparatus that washes laundry using an interfacial separation action of detergent or a current of washing water.

The laundry is put into the tub of the washing machine, and then water and detergent are supplied. When the outer tub is filled with water to a certain level, the inner tub starts to rotate to wash the laundry.

A water spraying unit may be installed in the washing machine. The water spraying unit has a function of circulating washing water from the outer tub and spraying the washing water into the inner tub. As the water spraying unit sprays the washing water into the inner tub while washing the laundry, the laundry is wetted more quickly, thereby improving the washing efficiency of the washing machine.

In the prior art, the water spraying unit is configured to spray the washing water into the inner tub, using an independent pump or water pressure of the water supplying unit. Therefore, there may be a limit to increasing the pressure for spraying the washing water.

SUMMARY

In view of the above, the present disclosure is created to solve such a problem, and provides a washing machine and washing method capable of improving washing performance.

Further, the present disclosure provides a washing machine and washing method in which the laundry can be wetted quickly.

Exemplary embodiments of the present disclosure provide a washing machine including an air storage unit configured to store air therein; a compression unit configured to communicate with the air storage unit and the outer tub, and to compress the air in the air storage unit by compressing water from an outer tub of the washing machine; a water spraying tube connected to the compression unit and a tub cover; and an opening and closing unit configured to open and close a flow path of the water spraying tube, wherein the opening and closing unit is configured to cause water to be sprayed into an inner tub using the compressed air from the air storage unit.

Further, the compression unit may comprise a connecting tube member connected to the outer tub; a valve configured to introduce water from the outer tub to the connecting tube member, wherein the valve is in the connecting tube member; a compression tubing member connected to the water spraying tube, wherein the compression tubing member is connected to the connecting tube member and the air storage unit; and a compression piston configured to compress air from the air storage unit and guide water from the compression tubing member to a side of the air storage unit, wherein the compression piston reciprocates in the compression tubing member.

Further, the washing machine may further comprise a check valve configured to prevent the water in or on the side of the air storage unit from being guided to a side of the compression piston. The check valve may be in the compression tubing member at a position between the connecting tube member and the opening and closing unit.

Further, the connecting tube member may be connected to a lower part of the outer tub, and the air storage unit may be at a higher position than the compression tubing member.

Further, the tub cover may comprise a spray nozzle connected to the water spraying tube; a space forming portion or unit configured to form a space for spraying the water at a side of an outlet of the spray nozzle; and a convex water scattering portion or unit toward an opposite side of the spray nozzle from the space forming portion or unit.

Further, the water scattering portion or unit may have a hemispherical or shell shape that is cut away in part.

Further, the space forming portion or unit may have a square or box shape with an open lower part, and include a wall sloping downwardly at an opposite side of the spray nozzle.

Further, the wall may be rounded along the inner periphery of the tub cover.

Further, the wall may expand toward an inner side of the tub cover at sides of the space forming portion or unit.

Other exemplary embodiments of the present disclosure provide a washing method for a washing machine. The washing method may comprise rotating an inner tub; introducing washing water from an outer tub to a compression tubing member; compressing air in an air storage unit by guiding the water of the compression tubing member to a side of the air storage unit using a compression piston; and spraying the water into the inner tub using the compressed air from the air storage unit and opening an opening and closing unit of a water spraying tube.

Further, spraying the water into the inner tub may comprise causing the water to contact a water scattering portion or unit and scattering it in the inner tub.

Further exemplary embodiments of the present disclosure provide a washing machine including an outer tub configured to contain an inner tub; and a tub cover configured to cover an upper peripheral portion of the outer tub. The tub cover may comprise a spray nozzle configured to spray washing water into the inner tub; a branch opposed to an outlet of the spray nozzle and expanding around the spray nozzle, the washing water being sprayed from the spray nozzle or sides of the spray nozzle; and a scattering angle limiting portion or unit opposed to the branch or sides thereof and configured to form a branch flow path together with the branch.

Further, the branch may comprise an opposing portion or section opposed to the outlet or end of the spray nozzle; and an expanding portion or section extending and/or spreading toward sides of the spray nozzle and/or around the opposing portion or section.

Further, the expanding portion or section may slope toward a lower or underside of the tub cover.

Further, the scattering angle limiting portion or unit may be higher than the branch.

Further, the scattering angle limiting portion or unit may be parallel to the expanding portion or section to form the branch flow path together with the expanding portion or section.

According to exemplary embodiments of the present disclosure, the compression unit compresses air in the air storage unit by guiding the water to the air storage unit, and the water is sprayed by a force of the air to be expanded in the air storage unit, thereby enhancing washing performance of the washing machine. Also, as the washing water is sprayed evenly to the laundry, the laundry can be wetted quickly, thereby improving the washing efficiency of the washing machine.

Further, according to exemplary embodiments of the present disclosure, while the compression piston is reciprocating, the water can be blocked off from returning from the side of the air storage unit to the compressed air unit, thereby preventing the compression force of the air in the air storage unit from decreasing.

Further, according to exemplary embodiments of the present disclosure, the washing water is scattered by contacting the water scattering portion or unit, which may prevent the washing water from scattering to the outside of the tub.

Further, according to exemplary embodiments of the present disclosure, as the water sprayed from the spray nozzle is sprayed evenly to the laundry, the laundry can be wetted quickly from the beginning of washing cycle, thereby improving the washing efficiency. Also, the scattering angle of the water can be limited, thereby preventing the water from spraying to the outside of the outer tub.

Further, according to exemplary embodiments of the present disclosure, damage to electrical/electronic components of the washing machine can be minimized due to moisture or water. Also, the water is sprayed onto the laundry in a spray form, thereby wetting the laundry quickly.

BRIEF DESCRIPTION OF THE DRAWINGS

The above and other objects and features of the present disclosure will become apparent from the following description of embodiments given in conjunction with the accompanying drawings, in which.

DETAILED DESCRIPTION

Hereinafter, a drum washing machine in accordance with exemplary embodiments of the present disclosure will be described with reference to the accompanying drawings. For purposes convenience and/or concise explanation, the following description will be made with respect to a washing machine in which an inner tub rotates on a rotation axis (e.g., that is perpendicular to a wall or surface of the inner tub attached or affixed to a rotation shaft driven by a motor). In the present description, thicknesses of lines, sizes of components, or the like, illustrated in the accompanying drawings may be exaggerated for clarity and convenience of explanation. Further, the following terms are defined in consideration of the functions in the present disclosure and may be construed in different ways according to the intention of users and operators. Therefore, the definitions of terms used herein should be construed based on the contents throughout the specification.

Washing machines may be classified into agitator type (or a bin rolling type) washing machines, pulsator type washing machines, and drum type washing machines, depending on their washing schemes. In an agitator type and pulsating type washing machines, the laundry is washed while rotating the inner tub on a perpendicular rotation axis. In the agitator type washing machine, the inner tub only is rotated, and in the pulsating type washing machine, the inner tub and the pulsator (i.e., laundry wings) are rotated. In a drum type washing machine, the laundry is washed while rotating the inner tub on a horizontal or near horizontal rotation axis.

For any type of washing machine in which the water is sprayed into the inner tub while the laundry is washed, the present disclosure may be applied, especially to washing machines such as an agitator type, a pulsator type and a drum type. Hereinafter, a washing machine that rotates a tub or drum on a perpendicular rotation axis will be described as an example.

Figure 1:
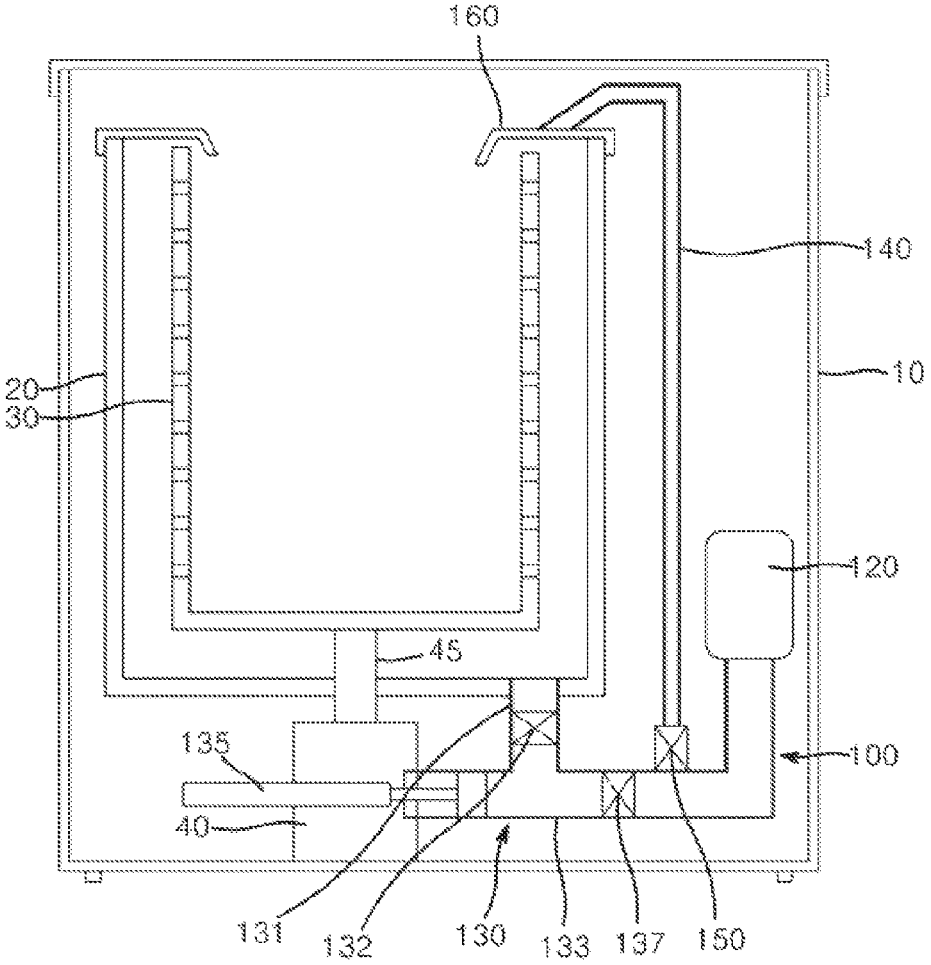
FIG. 1 is a structural view schematically illustrating an exemplary washing machine in accordance with one or more embodiments of the present disclosure.
Figure 2:
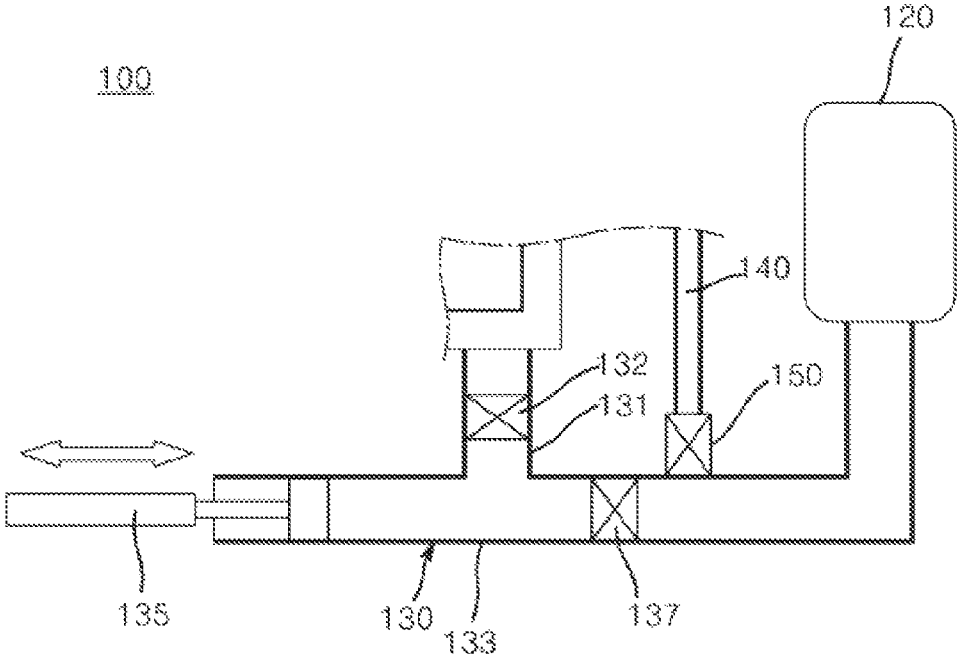
FIG. 2 is a structural view schematically illustrating an exemplary water spraying unit of the exemplary washing machine in accordance with one or more embodiments of the present disclosure.

FIG. 1 is a structural view schematically illustrating an exemplary washing machine in accordance with one or more embodiments of the present disclosure, and FIG. 2 is a structural view schematically illustrating an exemplary water spraying unit for the exemplary washing machine in accordance with one or more embodiments of the present disclosure.

Referring to FIGS. 1 and 2, the exemplary washing machine is equipped with an outer tub 20 and an inner tub or drum 30 inside a case 10. Water is supplied inside the outer tub 20 using a water supplying unit. The rotatable inner tub or drum 30 is disposed inside the outer tub 20. The inner tub 30 includes a plurality of holes so that water in the outer tub 20 flows in and out of the inner tub or drum 30. A drive unit 40 is disposed at the lower side of (e.g., below) the outer tub 20, and is connected to the inner tub 30 via a shaft 45 extending through the outer tub 20. The drive unit 40 rotates the inner tub 30 on a rotation axis perpendicular to its bottom wall or surface. Inside the case 10, a water spraying unit 100 is installed.

The water spraying unit 100 includes an air storage unit 120, a compression unit 130, a water spraying tube 140, and an opening and closing unit (e.g., valve) 150. The air storage unit 120 and the compression unit 130 of the water spraying unit 100 may be inside or outside the case 10.

The air storage unit 120 is outside the outer tub 20. In the air storage unit 120, air is stored. An air supplying unit (not shown) may be connected to the air storage unit 120 to supply external air to the air storage unit 120.

The air storage unit 120 may be at a position higher than a compression tubing member 133 which will be described below. When the air storage unit 120 is higher than the compression tubing member 133, the water in the compression tubing portion 133 can be prevented from flowing into the air storage unit 120. Accordingly, before the water in the compression tubing member 133 is guided toward the air storage unit 120, a sufficient amount of air can be stored in the air storage unit 120.

Further, when the opening and closing unit 150 is opened and the water is sprayed into the inner tub 30, a relatively large amount of compressed air can expand in the air storage unit 120, thereby increasing the spraying pressure of the water.

The compression unit 130 enables communication between the air storage unit 120 and the outer tub 20. The compression unit 130 compresses air in the air storage unit 120 by guiding, pumping or forcing water from the outer tub 20 into the air storage unit 120. Hereinafter, an embodiment of the compression unit 130 will be described.

An exemplary compression unit 130 includes a connecting tube member 131, a valve 132, a compression tubing member 133, and a compression piston 135.

The connecting tube member 131 is connected to the outer tub 20. For example, the connecting tube member 131 is connected to the lower part (e.g., the lowermost wall or surface) of the outer tub 20 so that water in the outer tub 20 can flow into the connecting tube member 131 without a separate power source.

The valve 132 is in the connecting tube member 131 where the water from the outer tub 20 flows into the connecting tube member 131. While the valve 132 allows the water from the outer tub 20 to enter the compression tubing member 133, the valve 132 may be a check valve that prevents the water in the compression tubing member 133 from returning to the outer tub 20. Also, the valve 132 may be an opening and closing valve that opens and closes the flow path of the connecting tube member 131.

The compression tubing member 133 is connected to the connecting tube member 131 and the air storage unit 120. The compression tubing member 133 may be or comprise a cylinder that forms a flow path between the connecting tube member 131 and the air storage unit 120. Further, the compression tubing member 133 has sufficient strength to withstand pressure of the water generated when the water is forced, compressed or pumped by the compression piston 135. The compression tubing member 133 may have a circular or polygonal cross-sectional shape.

The compression piston 135 reciprocates in the compression tubing member 133. The compression piston 135 may be disposed at a side of the compression tubing member 133 opposite from the air storage unit 120 when viewing the connecting tube member 131. As the water in the compression tubing member 133 is forced, compressed or pumped by the compression piston 135, the water flows into the air storage unit 120. Air in the air storage unit 120 is compressed until the equilibrium of pressures from the air and the water are increased to a predetermined or approximate value.

The water spraying tube 140 is connected to the compression unit 130. One side of the water spraying tube 140 is connected to the compression tubing member 133 of the compression unit 130, and another side of the water spraying tube 140 is disposed toward the inside of the inner tub 30. The water spraying tube 140 provides a flow path for the water to be sprayed into the inner tub 30 from the compression tubing member 133.

The opening and closing unit 150 is configured to open and close the flow path of the water spraying tube 140. The opening and closing unit 150 may be at a connection between (e.g., the connecting member of) the compressing tubing member 133 and the water spraying tube 140. When the opening and closing unit 150 is open, air compressed in the air storage unit 120 forces the water W in the compression unit 130 to be sprayed into the inner tub 30. While the compressed air of the air storage unit 120 expands (and, for example, the check valve 137 is closed), the water in the compression tubing member 133 is pumped through the water spraying tube 140, thereby improving washing efficiency due to increasing the spraying pressure of the water.

The compression tubing member 133 may further include a check valve 137 between the connecting tube member 131 and the opening and closing unit 150. The check valve 137 may prevent the water between the air storage unit 120 and the check valve 137 from returning toward the compression piston 135. As the check valve 137 allows the water in the compression tubing member 133 to flow only toward the water spraying tube 140, the water W between the check valve 137 and the air storage unit 120 may be prevented from flowing back toward the compression piston 135. Accordingly, when the water W is forced toward the air storage unit 120 by the compression piston 135, the air pressure in the air storage unit 120 may be prevented from decreasing.

Figure 3:
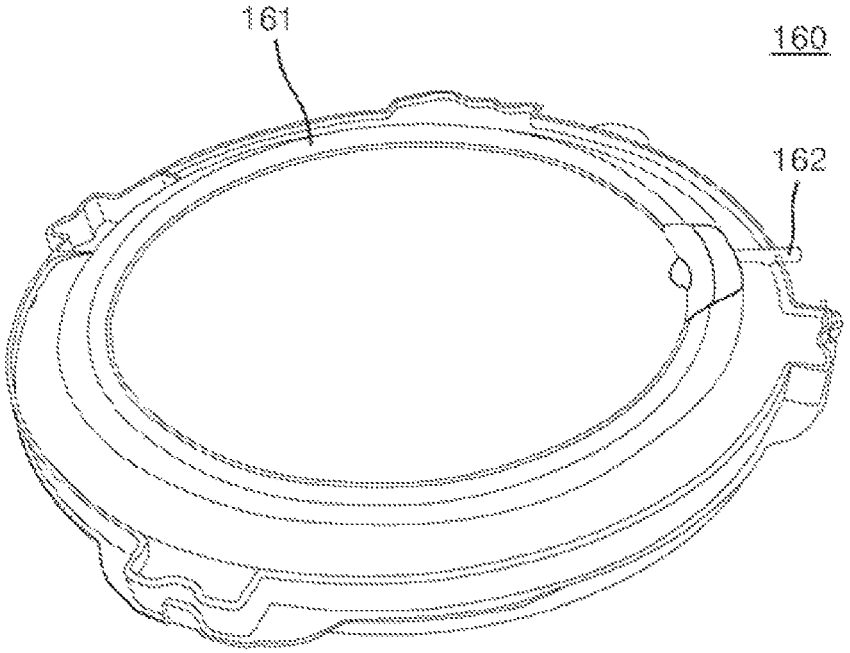
FIG. 3 is a perspective view illustrating an exemplary tub cover of the exemplary washing machine in accordance with one or more embodiments of the present disclosure.
Figure 5:
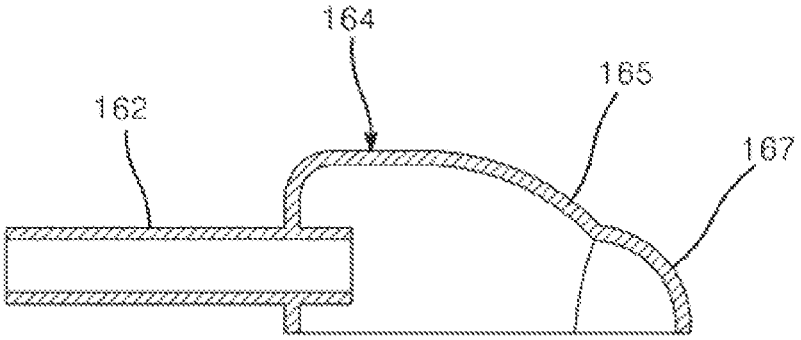
FIG. 5 is a cross-sectional view taken along line V-V of the exemplary space-forming portion or unit in accordance with one or more embodiments of the present disclosure.

FIG. 3 is a perspective view illustrating an exemplary tub cover for the exemplary washing machine in accordance with one or more embodiments of the present disclosure, FIG. is a rear view illustrating an exemplary space forming portion or unit and an exemplary water scattering portion or unit of the exemplary washing machine in accordance with one or more embodiments of the present disclosure, and FIG. 5 is a cross-sectional view taken along line V-V of an exemplary space-forming portion or unit for the exemplary washing machine in accordance with one or more embodiments of the present disclosure.

Figure 4:
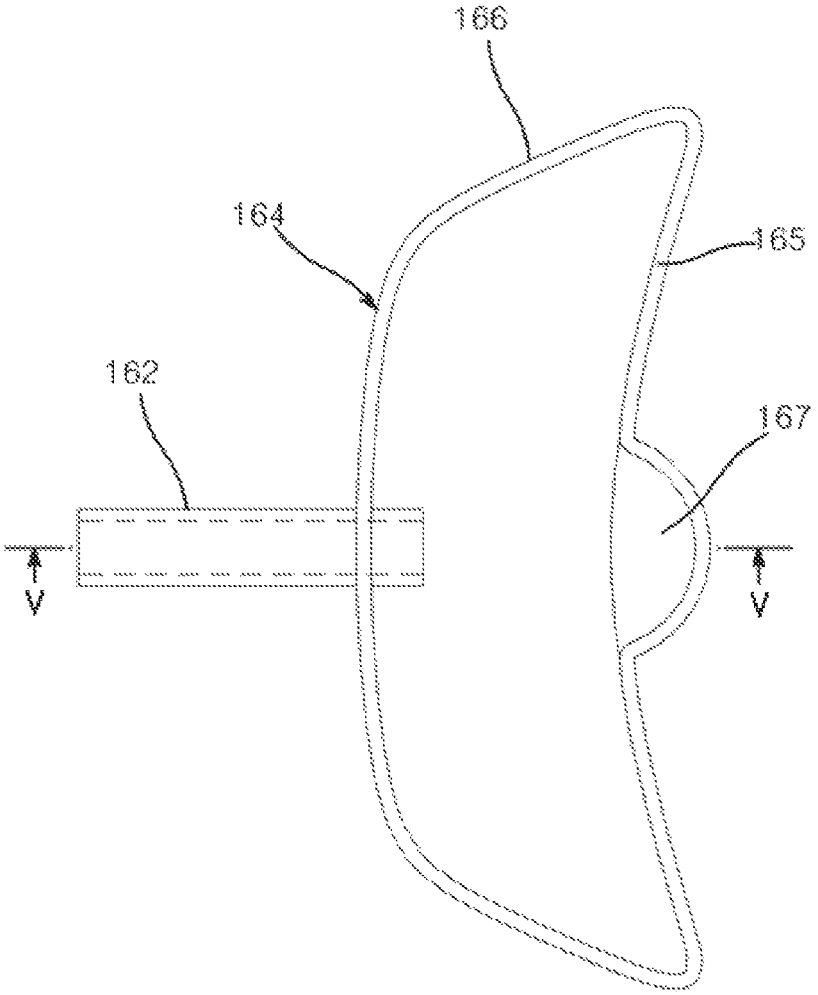
FIG. 4 is a rear view illustrating an exemplary space forming portion or unit and an exemplary water scattering portion or unit of the exemplary washing machine in accordance with one or more embodiments of the present disclosure.

Referring to FIGS. 3 through 5, an exemplary tub cover 160 includes a main body 161, a spray nozzle 162, a space forming portion or unit 164 and a water scattering portion or unit 167.

In the main body 161 of the tub cover 160, the spray nozzle 162 is connected to the water spraying tube 140 of the water spraying unit 100. The spray nozzle 162 may incline downwardly so that the water supplied from the water spraying tube 140 is sprayed into the inner tub 30. When the spray nozzle 162 inclines downwardly, the spray angle of the spray nozzle 162 may be directed toward the central axis of the inner tub 30.

The spray nozzle 162 may be integral with the main body 161 of the tub cover 160. With this configuration, the spray direction of the spray nozzle 162 may be prevented from deviating from the normal direction, if an error in assembling occurs. Further, the spray nozzle 162 may be prevented from being separated from the main body 161 of the tub cover 160 while the washing machine is operated. Also, assembling steps and assembling time may be reduced.

The space forming portion or unit 164 may form and/or provide a water spraying space at the outlet of the spray nozzle 162 (and/or a side thereof). The space forming portion or unit 164 may have a rectangular and/or frame (e.g., substantially rectangular or partial arc) that surrounds and/or encompasses space at the outlet of the spray nozzle 162 (and/or a side thereof). As the space forming portion or unit 164 surrounds and/or encompasses the spraying space at the outlet of the spray nozzle 162, scattering of the water sprayed by the spray nozzle 162 outside the water spraying space can be minimized. The space forming portion or unit 164 may shield or prevent water drops and/or the water from deviating from the spraying space.

The space forming portion or unit 164 may include a sloped wall 165 which inclines downwardly at a side of the space forming portion or unit 164 opposite from the spray nozzle 162. The sloped wall 165 may guide the water sprayed from the spray nozzle 162 to scatter into the inner tub 30.

The sloped wall 165 may be rounded along the inner periphery of the tub cover 160. As the sloped wall 165 smoothly follows the inner periphery of the tub cover 160, damage to the laundry can be prevented (e.g., possibly caused by hanging or being caught on the inner periphery of the tub cover 160 when the laundry is put into the inner tub 30).

On opposite sides of the space forming portion or unit 164, an expanding wall 166 may expand toward the inside of the tub cover 160 (e.g., from the spray nozzle 162). As the wall(s) 166 allow the spraying space for the water to expand toward the inside of the tub cover 160, the scattering water may be guided along the wall(s) 166, and thus can be smoothly introduced toward or smoothly flow into the inner tub 30.

In other words, as the expanding wall(s) 166 spread toward the inside of the tub cover 160, the scattering water flowing toward the (inner) periphery of the tub cover 160 can be guided smoothly toward the inner tub 30. Thus, using the expanding wall (s) 166 of the space forming portion or unit 164, water discharged out of the inner tub 30 and the outer tub 20 can be reduced or minimized.

The water scattering portion or unit 167 may have a convex shape and be at a side of the space forming portion or unit 164 opposite from the spray nozzle 162 (e.g., at the side of the sloped wall). Here, the water scattering portion or unit 167 may to have a shape of a hemisphere or shell cut away in part. As the exemplary water scattering portion or unit 167 has a hemispherical or shell shape cut away by about half, the water sprayed from the spray nozzle 162 may be scattered into the inner tub 30 within a predetermined range of angles. Further, the water may be scattered relatively evenly to the inner tub 30.

The water scattering portion or unit 167 may be designed having an appropriate size in accordance with a stream size, a spray amount and/or a spray or flow rate of the water sprayed from the spray nozzle 162.

The spray nozzle 162 may intensively spray the water onto the water scattering portion or unit 167. Here, the sprayed water mostly contacts the water scattering portion or unit 167, and the water can resultantly be sprayed evenly into the inner tub 30. Accordingly, the laundry is quickly wetted by the water W and thus, an interfacial activation and/or action of the detergent and/or debris removal can be actively carried out from the beginning of washing.

Further, as the water scattering portion or unit 167 is at a position where most of the sprayed water flows, most of the water can be scattered into the inner tub 30.

A portion of the sprayed water W may flow in a sideward direction away from the spray nozzle 162. A portion of the scattered water may be guided to the inner tub 30 by the slope(s) of the space forming portion or unit 164. Further, remaining water may be guided into the inner tub 30 by the expanding wall(s) 166 of the space forming portion or unit 164.

As described above, the space forming portion or unit 164 and the water scattering portion or unit 167 can cause the water from the spray nozzle 162 to be scattered evenly into the inner tub 30. As a result, the laundry can be wetted quickly at the beginning of washing, thereby remarkably improving the washing efficiency and increasing the actual washing time.

Further, as discharge of the scattered water out of the outer tub 20 can be minimized, damage to the washing machine by moisture or water can also be minimized.

Hereinafter, an exemplary washing method using the exemplary washing machine configured as above will be described.

Figure 6:
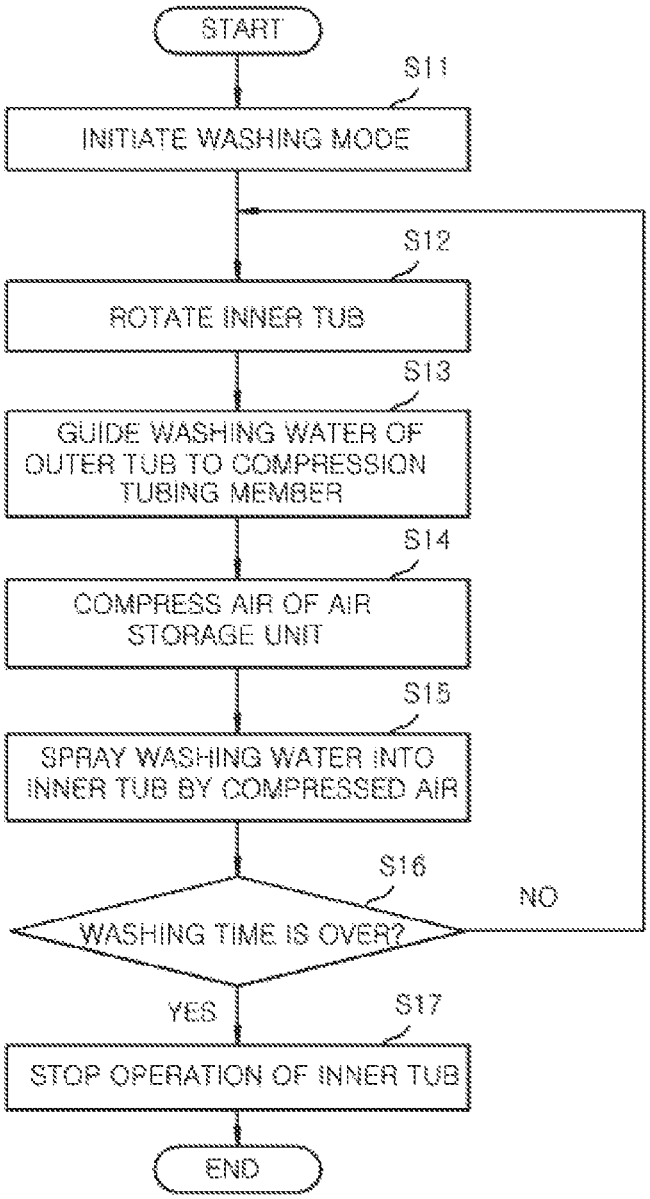
FIG. 6 is a flow chart illustrating an exemplary washing method in accordance with one or more embodiments of the present disclosure.
Figure 7:
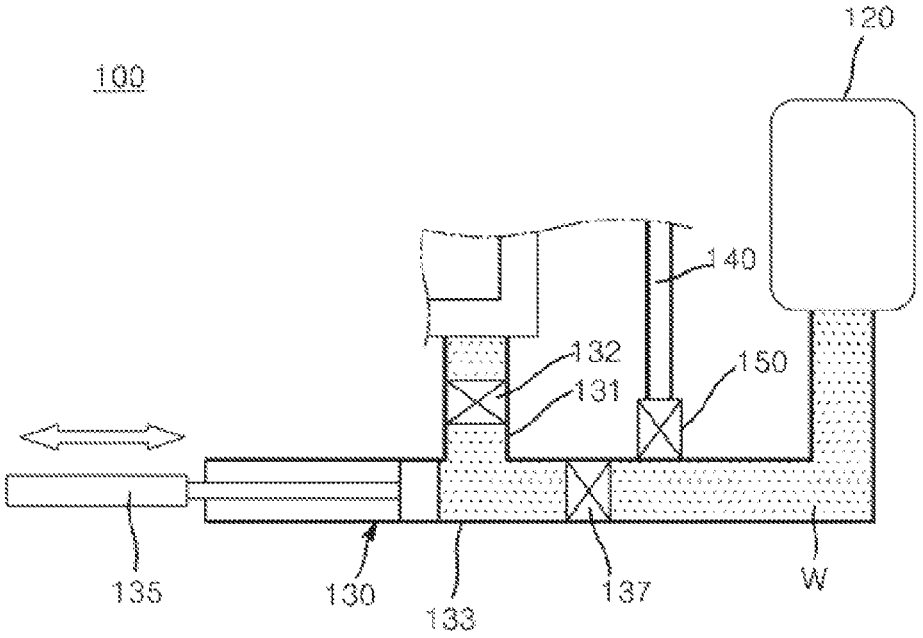
FIG. 7 is a structural view illustrating an exemplary process of compressing washing water toward the exemplary air storage unit by an exemplary compression unit in the exemplary washing machine in accordance with one or more embodiments of the present disclosure.
Figure 8:
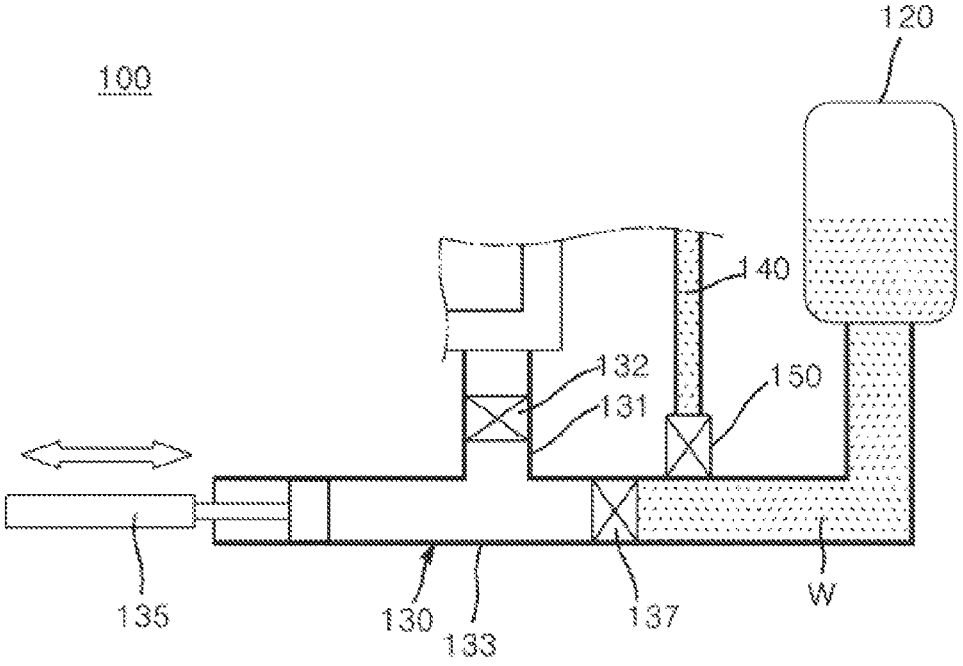
FIG. 8 is a structural view illustrating the washing water being sprayed using compressed air in the exemplary air storage unit in accordance with one or more embodiments of the present disclosure.
Figure 9:
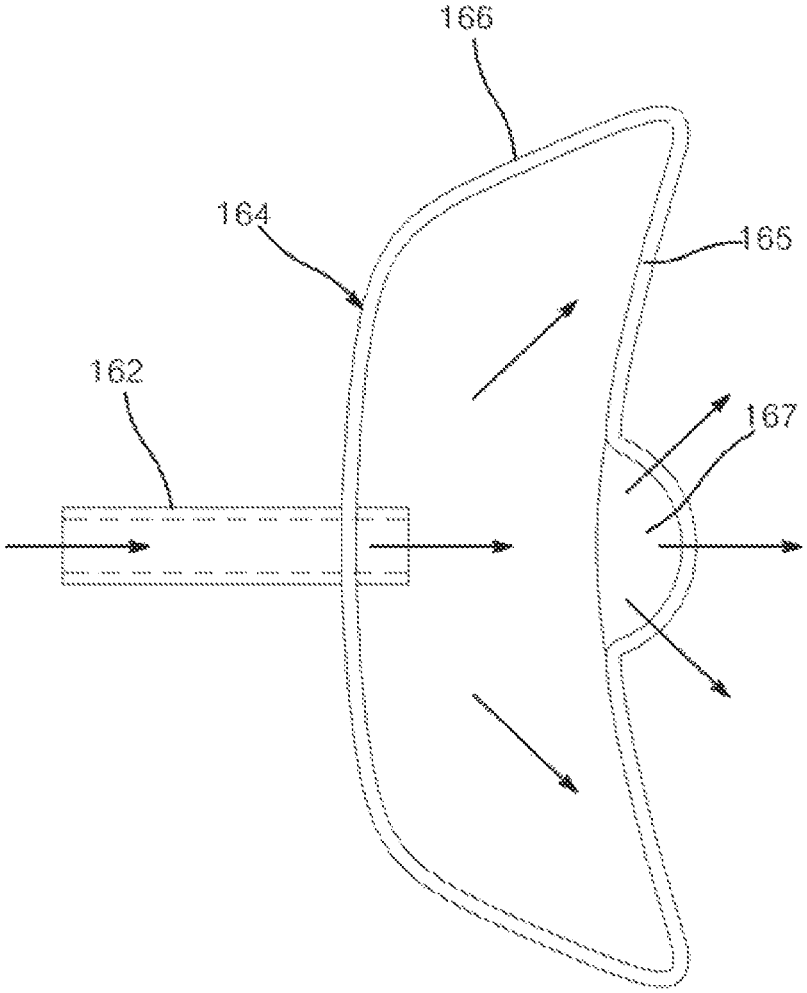
FIG. 9 is a rear view illustrating water being sprayed from the exemplary spray nozzle and scattered by the exemplary water scattering portion or unit in accordance with one or more embodiments of the present disclosure.
Figure 10:
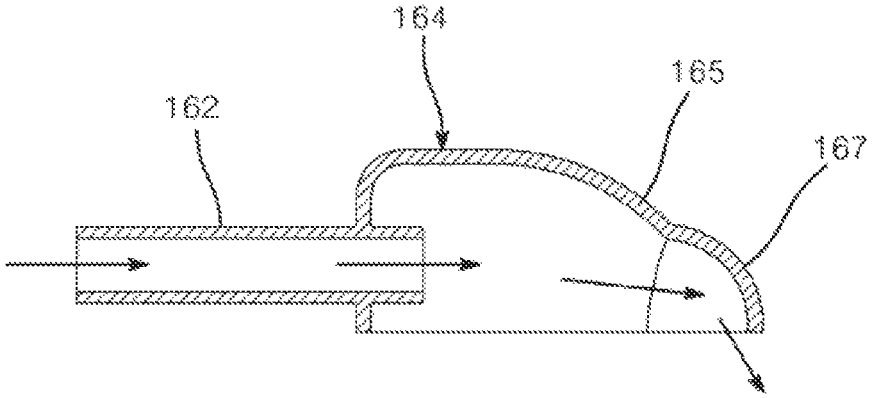
FIG. 10 is a cross-sectional view illustrating water being sprayed from the exemplary spray nozzle and scattered by the exemplary water scattering portion or unit in accordance with one or more embodiments of the present disclosure.

FIG. 6 is a flow chart illustrating an exemplary washing method using the exemplary washing machine in accordance with one or more embodiments of the present disclosure, FIG. 7 is a structural view illustrating an exemplary process for water to be compressed to the exemplary air storage unit using the exemplary compression unit in accordance with one or more embodiments of the present disclosure, FIG. 8 is a structural view illustrating spraying water using compressed air from the exemplary air storage unit to the exemplary water spraying tube in accordance with one or more embodiments of the present disclosure, FIG. 9 is a rear view illustrating water sprayed from the exemplary spray nozzle being scattered by the exemplary water scattering portion or unit in accordance with one or more embodiments of the present disclosure, and FIG. 10 is a cross-sectional view illustrating water sprayed from the spray nozzle being scattered by the exemplary water scattering portion or unit in accordance with one or more embodiments of the present disclosure.

Referring to FIGS. 6 through 10, when the washing mode is initiated at block S11, external water is supplied to the outer tub 20 and/or the inner tub 30 by a water supplying unit (not shown). The external water may be supplied to a predetermined level in the outer tub 20 by the water supplying unit according to a user's selection. Detergent may also be supplied to the outer tub 20 and/or the inner tub 30, together with or separately from the external water W.

When the external water W is completely supplied to the outer tub 20, the inner tub 30 is rotated from force provided by the drive unit 40 at block S12. By the rotation of the inner tub 30, a current of water occurs and the laundry is washed.

The washing water W of the outer tub 20 is guided to the compression tubing member 133 via the connecting tube member 131 at block S13. The valve 132 of the connecting tube member 131 may allow the water W from the outer tub 20 to flow into the compression tubing member 133.

As shown in FIG. 7, due to the pressure of the water W in the compression unit 130, the air in the air storage unit 120 is compressed at block S14. In other words, the compression piston 135 forces, pumps or otherwise compresses the water W in the compression tubing member 133 toward the air storage unit 120. As the water W flows into the air storage unit 120, the air in the air storage unit 120 is compressed. The air in the air storage unit 120 may be compressed until the equilibrium of forces of the air and the water W has been made (e.g., a predetermined pressure or force is applied to and/or provided by the air in the air storage unit 120 and/or the water W in the air storage unit 120 and the compression tubing member 133).

The valve 132 of the connecting tube member 131 prevents the water W in the compression tubing member 133 from flowing back towards the piston 135. Accordingly, the valve 132 of the connecting tube member 131 prevents the water W from flowing from the compression tubing member 133 to the outer tub 20, and the compression efficiency of the compression unit 130 can be improved.

As the compression piston 135 reciprocates multiple times, the water W in the compression tubing member 133 and the air in the air storage unit 120 may be compressed to a predetermined pressure. As the number of reciprocations of the compression piston 135 increases, the compression forces of the water W and the air may increase. When the air in the air storage unit 120 is completely compressed, the opening and closing unit 150 may be opened. The number of reciprocations of the compression piston 135 may vary properly in consideration of the capacity of the washing machine and the spraying pressure of the water W.

When the compression piston 135 reciprocates, the valve 137 in the compression tubing member 133 may prevent the water W from flowing back from the side of the compression tubing member 133 in open communication with the air storage unit 120 to the side of the compression tubing member 133 in open communication with the compression piston 135. Therefore, it is possible to prevent the compression force of the air in the air storage unit 120 from decreasing.

When the compression piston 135 has reciprocated a pre-set number of times, the opening and closing device 150 may be opened (see FIG. 8). Of course, when the air pressure in the air storage unit 120 has reached to pre-set pressure, the opening and closing unit 150 may also be opened.

When the opening and closing unit 150 is open, at block S15 (FIG. 6), the water W in the air storage unit 120 and the compression tubing member 133 to the right of the check valve 137 (see FIG. 8) is sprayed into the inner tub 30 as the compressed air in the air storage unit 120 expands. As the compressed air of the air storage unit 120 is released from the compression, the compressed air provides a strong spray pressure to the compressed water W in the compression tubing member 133, thereby increasing the spray pressure of the water W using the air pressure. As described above, an impact force of the water W can increase as the spray pressure of the water W in the water spray tube 140 increases, thereby improving the laundry washing efficiency.

As described above, as the step of compressing the air using the compression unit 130 and opening the opening and closing unit 150 to spray the water W is repeated during the washing time and/or operation, the laundry is washed.

The control unit may determine, at block S16 (FIG. 6), whether the washing time of the washing machine is over. When the washing time is over, at module S17, operation of the drive unit 40 may be stopped in order to stop the rotation of the inner tub 30.

In the meantime, the water flows or sprays into the space forming portion or unit 164 and onto the water scattering portion or unit 167 via the spray nozzle 162 (see FIGS. 9 and 10). As water from the spray nozzle 162 can scatter evenly to the inner tub 30, the laundry is wetted quickly, and thus the washing efficiency can be remarkably improved, and the actual washing time can be increased.

Further, discharge of the water to the outside of the outer tub 20 can be minimized, thereby minimizing damage to the washing machine caused by moisture or water.

Following the above described washing cycle, a rinsing cycle and an optional dehydrating (e.g., drying) cycle may be carried out continuously or sequentially.

Figure 11:
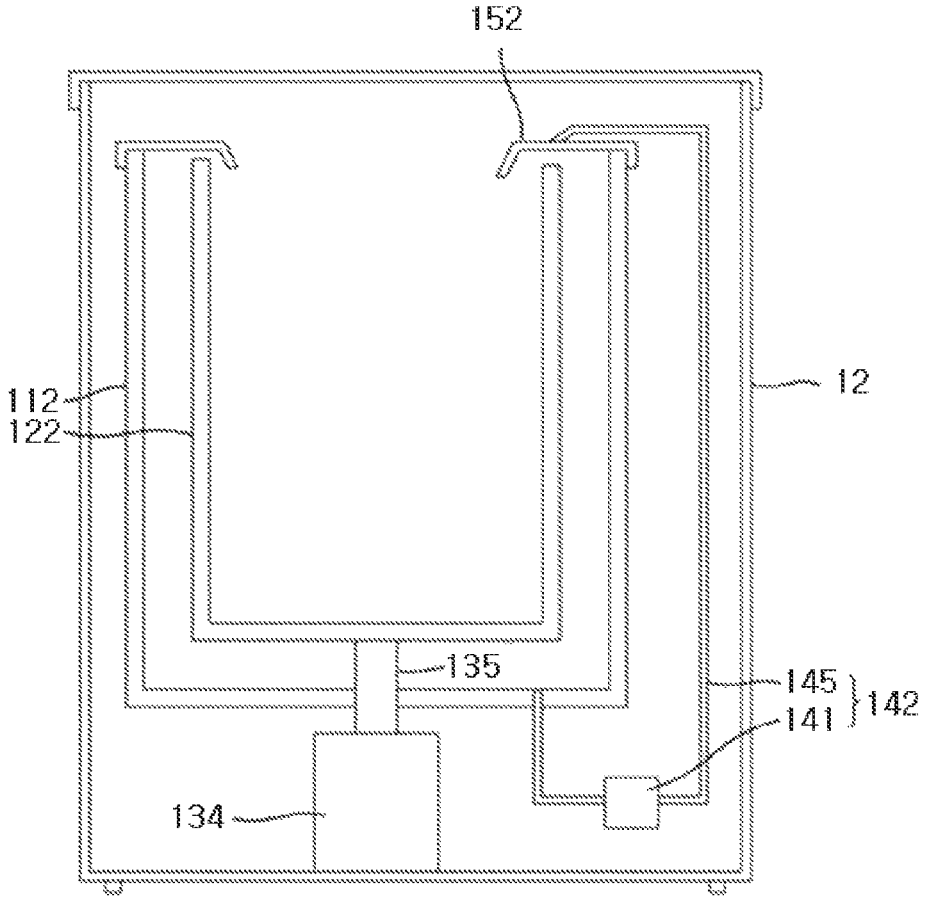
FIG. 11 is a schematic view of an exemplary washing machine in accordance with one or more further embodiments of present disclosure.

FIG. 11 is a schematic view illustrating an exemplary washing machine in accordance with one or more further embodiments of the present disclosure.

Referring to FIG. 11, the exemplary washing machine includes an outer tub 112 and a tub cover 152.

In the case 12, the outer tub 112 is installed, and water fills the outer tub 112 from a water supplying unit (not shown). In the outer tub 112, the rotatable inner tub 122 is installed. The inner tub 122 includes a plurality of holes in the cylindrical sidewall for the water to pass through.

Below the outer tub 112, a drive unit 134 is installed and is coupled to the inner tub 122 by a shaft 135 through the outer tub 112. The drive unit 134 includes a driving motor and the shaft 135.

The water spraying unit 140 is connected. The water spraying unit 140 includes a water spraying tube 145 which connects the lower side or lowermost surface of the outer tub 112 and the tub cover 152 to each other, and a water pump 141 which is connected to the water spraying tube 145. The water spraying unit 140 pumps the washing water from the outer tub 112 and sprays the washing water into the inner tub 122.

The tub cover 152 is coupled to the upper side of the outer tub 112. The tub cover 152 covers the periphery of the upper side of the outer tub 112. The tub cover 152 may have an O-, ring or donut shape.

Figure 12:
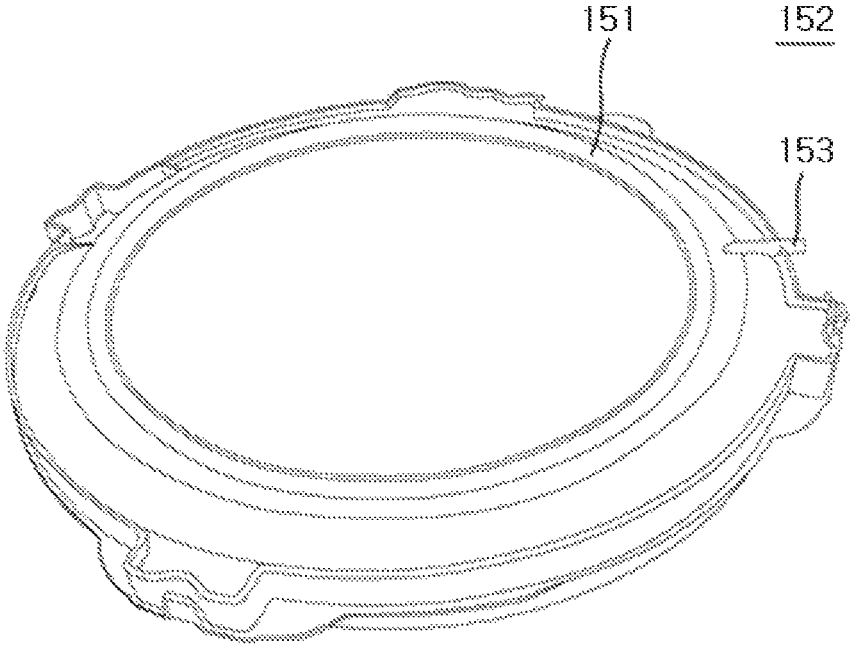
FIG. 12 is a perspective view of an exemplary tub cover for the exemplary washing machine of FIG. 11.
Figure 13:
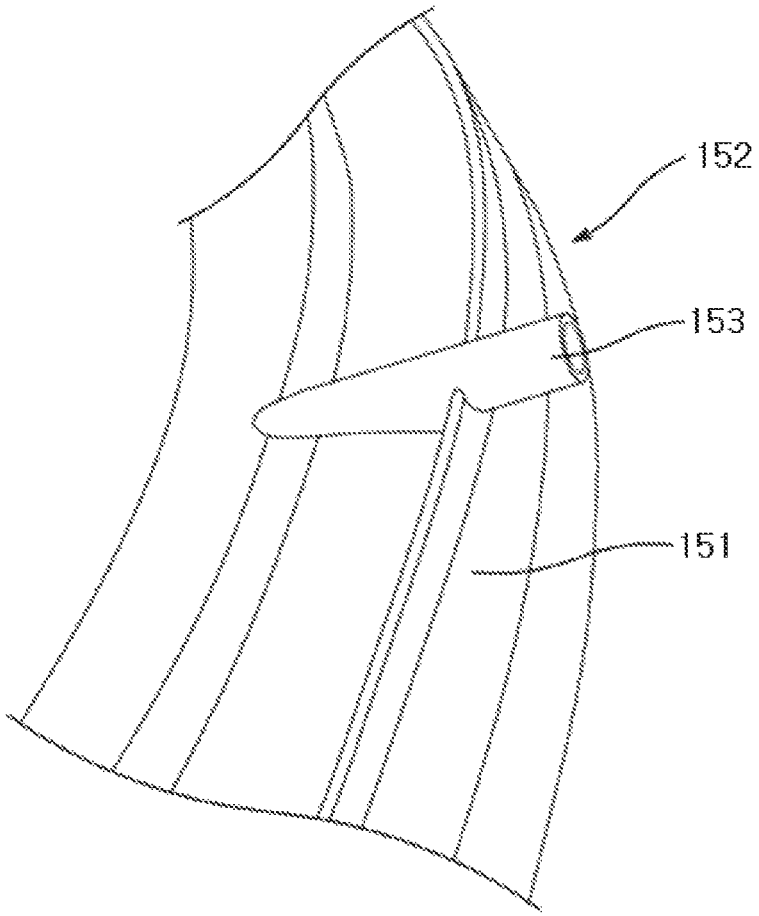
FIG. 13 is an enlarged view of an exemplary spray nozzle for the exemplary tub cover of FIG. 12.
Figure 14:
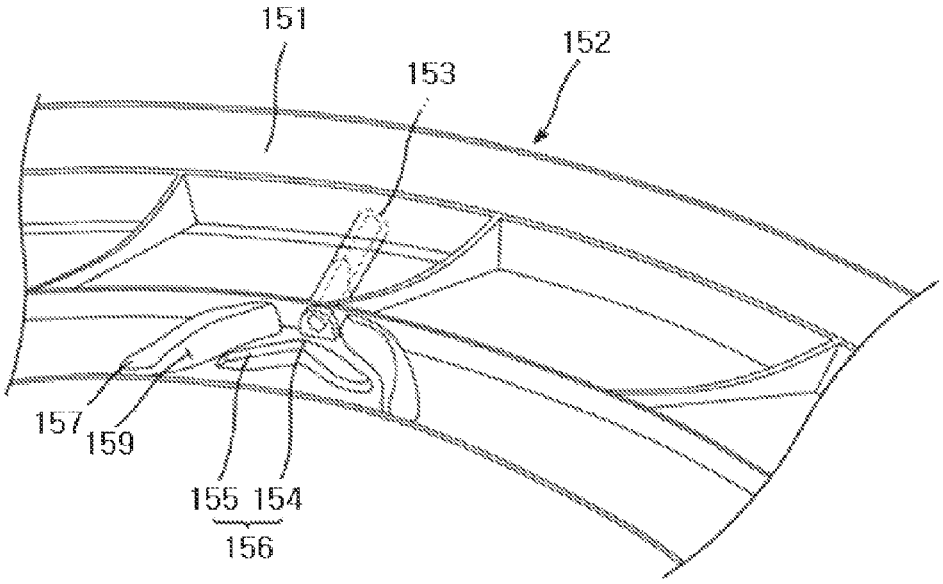
FIG. 14 is an enlarged view of the underside of the exemplary tub cover of FIG. 12.

FIG. 12 is a perspective view of the exemplary tub cover of FIG. 11, FIG. 13 is an enlarged view of the exemplary spray nozzle of FIG. 12, and FIG. 14 is an enlarged view of the rear or underside of the exemplary tub cover of FIG. 12.

Referring to FIGS. 12 through 14, the tub cover 152 includes a main body 151, a spray nozzle 153, a branch 153 and a scattering angle limiting portion or unit 157.

In the main body 151 of the tub cover 152, the spray nozzle 153 is formed and is connected to the water spraying tube 145 of the water spraying unit 140. The spray nozzle 153 may spray the water supplied from the water spraying tube 145 into the inner tub 122. The spray nozzle 153 may have an outlet that slopes downwardly.

The spray nozzle 153 may be integral with the main body 151 of the tub cover 152. Thus, the direction of the spray nozzle 153 may be prevented from changing, or for the spray nozzle 153 from separating from the main body 151. Further, when the spray nozzle 153 is integral with the main body 151, assembling steps and assembling time of the tub cover 152 can be reduced.

The branch 156 (FIG. 14) is at a position on the underside of the tub cover 152 opposite to the outlet or end of the spray nozzle 153 (e.g., in the flow path of the water from the spray nozzle 153). The branch 156 may have an expanding shape, and extend in opposing directions across the spray nozzle 153. Accordingly, the water sprayed from the spray nozzle 153 can branch away from the spray nozzle 153 (e.g., is opposing directions). The branch 156 may have a generally rounded shape, or an angularly bent shape. For example, the branch 156 may have a gently rounded arc shape or gently bent (e.g., "Λ") shape. Hereinafter, an exemplary branch 156 with a "Λ" shape will be described by way of example.

The branch 156 includes an opposing portion or section 154 and an expanding portion or section 155.

The opposing portion or section 154 may be positioned so as to be opposed to the water outlet or end of the spray nozzle 153 (e.g., in the direct flow or spray of water from the spray nozzle 153). In this case, the opposing portion or section 154 may be spaced apart from the outlet or end of the spray nozzle 153 by a predetermined distance. As the opposing portion or section 154 is opposed to the water outlet or end of the spray nozzle 153, the water sprayed or flowing from the spray nozzle 153 contacts the opposing portion or section 154.

The expanding portion or section 155 may spread in opposing directions away from the spray nozzle 153 and extend from the opposing portion section 154. The expanding portion or section 155 may slope toward the tub cover 152. Thus, the water sprayed or flowing from the spray nozzle 153 may scatter into the inner tub 122 using the sloped plane or surface of the expanding portion or section 155.

The exemplary scattering angle limiting portion or unit 157 is formed and/or positioned so as to oppose the expanding portions or sections 155 of the branch 156. The scattering angle limiting portion or unit may consist of a single piece extending on opposed sides of the spray nozzle 153, or comprise a plurality of pieces (e.g., two), each on one side of the spray nozzle 153. The scattering angle limiting portion(s) or unit(s) 157 are spaced apart from the expanding portion(s) or section(s) 155 of the branch 156 in order to form a branch flow path 159 together with the branch 156. The scattering angle limiting portion(s) or unit (s) 157 may cause the water contacting the branch 156 to be guided with two forked paths or a split path, and can prevent the water from splashing out of or leaving the path(s) defined in part by the scattering angle limiting portion(s) or unit(s) 157.

The scattering angle limiting portion(s) or unit(s) 157 may be parallel to or along the expanding portion(s) or section(s) 155. Between the scattering angle limiting portion or unit 157 and the expanding portion or section 155, the branch flow path 159 may be formed. Accordingly, the water may be guided smoothly along the branch flow path 159 between the scattering angle limiting portion or unit 157 and the expanding portion or section 155.

A separation distance between the scattering angle limiting portion or unit 157 and the branch 156 may be suitably designed in consideration of the amount, flow rate and/or pressure of the water from the spray nozzle 153.

The scattering angle limiting portion or unit 157 may be higher (e.g., have a greater height) than the height of the branch 156. As the scattering angle limiting portion or unit 157 is higher than the height of the branch 156, the water sprayed from the spray nozzle 153 may be prevented from scattering out of the scattering limiting portion or unit 157. The height of the scattering angle limiting portion or unit 157 may be determined in consideration of the pressure, flow rate and/or amount of the water from the spray nozzle 153.

Hereinafter, the action of the exemplary washing machine configured as set forth above in accordance with further embodiment (s) of the present disclosure will be described.

Figure 15:
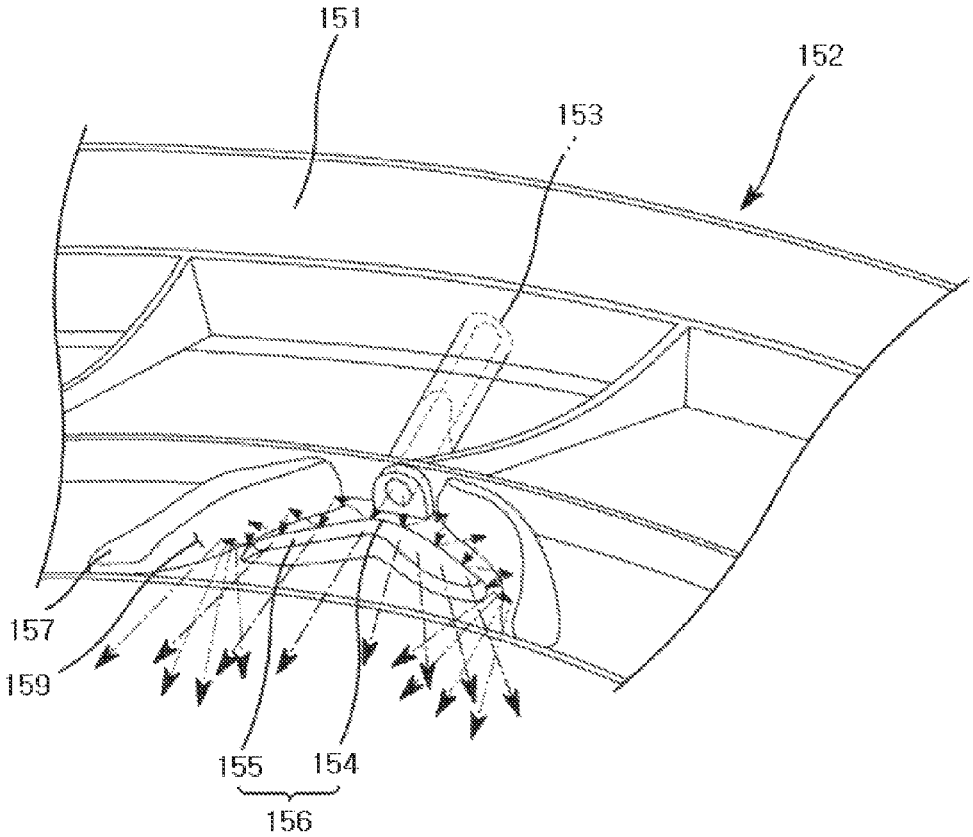
FIG. 15 is an enlarged view illustrating the spraying form of the water at the exemplary tub cover of FIG. 14.
Figure 16:
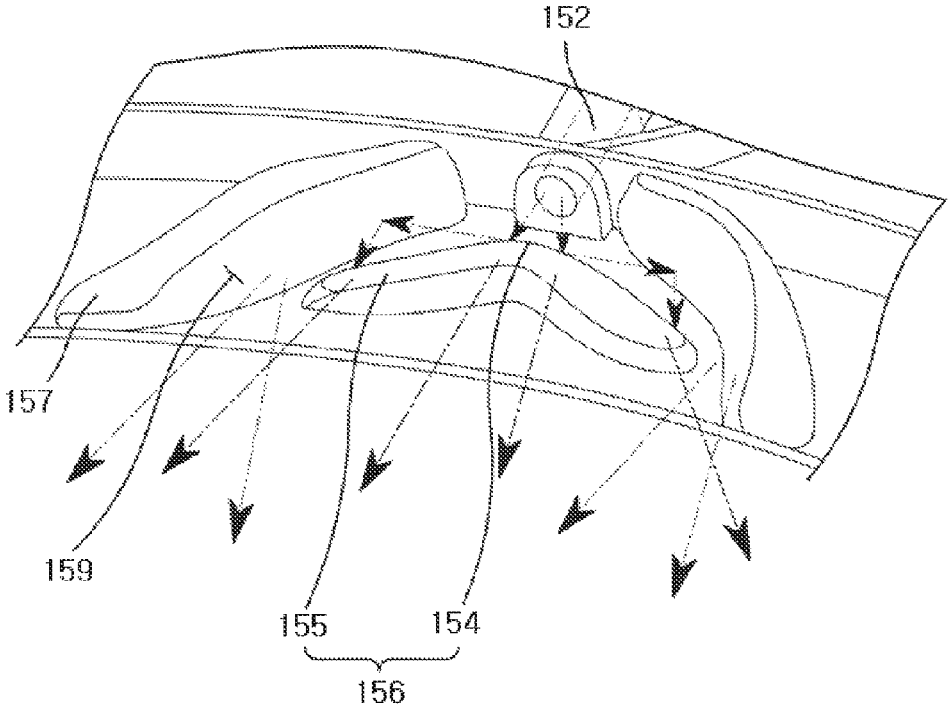
FIG. 16 is an enlarged view illustrating the spraying form of the water at the exemplary branch and exemplary scattering angle limiting portion or unit of FIG. 15.

FIG. 15 is an enlarged view illustrating the spraying form of the water at or on the tub cover of FIG. 14, and FIG. 16 is an enlarged view illustrating the spraying form of the water at or on the branch and the scattering angle limiting portion or unit of FIG. 15.

Referring to FIGS. 15 and 16, the spray nozzle 153 sprays the water onto the opposing portion or section 154 of the branch 156. The water may be guided along the branch flow paths 159 while contacting the expanding portions or sections 155 and the inner side of the scattering angle limiting portions or units 157.

The expanding portions or sections 155 may be sloped toward the lower and/or inner side of the tub cover 152, and thus the water along the branch flow paths 159 may scatter inside the inner tub 122 along the sloped plane or surface of the expanding portions or sections 155.

Further, as the scattering angle limiting portions or units 157 are parallel or substantially parallel to the (longitudinal) direction of the expanding portions or sections 155, the water along the branch flow path 159 is mostly prevented from flowing over the scattering angle limiting portions or units 157. Accordingly, the water from the spray nozzle can be prevented from scattering outside the inner tub 122 and the outer tub 112.

The branch 156 and the scattering angle limiting portion(s) or unit(s) 157 may cause the water from the spray nozzle 153 to flow along two forked or split paths, and also may cause the water to scatter onto the laundry within an angle range of the branch flow path(s) 159.

While the inner tub 122 rotates, the water may also be scattered or sprayed within an angle range of the branch 156 or the scattering angle limiting portion(s) or unit(s) 157 in the inner tub 122. Further, the branch 156 and the scattering angle limiting portion or unit 157 make the water to be scattered within a predetermined angle range, and thus the water from the water spraying tube 145 can be scattered or sprayed onto the laundry.

Therefore, the water can be sprayed evenly onto the laundry, and thus the laundry can be wetted quickly. When the laundry is wetted quickly, an interfacial activation action and/or debris removal from the laundry can be initiated from the beginning of the washing cycle. Accordingly, the washing efficiency can be improved.

Further, during the washing cycle of the washing machine, the water can be sprayed continuously (or intermittently, but repeatedly) to the inner tub 122, thereby saving a consumption of the water.

Further, the scattered water can be prevented from being sprayed outside the outer tub 112, thereby preventing electrical/electronic components of the washing machine from being damaged.

While the invention has been shown and described with respect to various embodiments, the present disclosure is not limited thereto. It will be understood by those skilled in the art that various changes and modifications may be made without departing from the scope of the invention as defined in the following claims.

Therefore, the scope of the present disclosure will be interpreted by the claims below, and it will be construed that all techniques within the scope equivalent thereto belong to the scope of the present disclosure.

What is claimed is:

1. A washing machine comprising:

an inner tub having a plurality of holes formed therein;

an outer tub configured to contain the inner tub, wherein water in the outer tub flows in and out of the inner tub through the plurality of holes;

a drive unit being disposed at a lower side of the outer tub, and connected to the inner tub via a shaft extending through the outer tub, wherein the drive unit rotates the inner tub;

an air storage unit configured to store air therein;

a compression unit configured to communicate with the air storage unit and the outer tub, and to compress the air in the air storage unit by compressing water from the outer tub;

a water spraying tube connected to the compression unit and a tub cover; and an opening and closing unit configured to open and close a flow path of the water spraying tube and cause water to be sprayed into the inner tub using compressed air from the air storage unit;

wherein the compression unit comprises:

a connecting tube member connected to the outer tub;

a valve configured to introduce water from the outer tub to the connecting tube member, wherein the valve is in the connecting tube member;

a compression tubing member connected to the water spraying tube, wherein the compression tubing member is connected to the connecting tube member and the air storage unit; and a compression piston configured to compress the air in the air storage unit by guiding water from or in the compression tubing member to the air storage unit, wherein the compression piston reciprocates inside the compression tubing member; and wherein the connecting tube member is connected to a lower part of the outer tub, and the air storage unit is at a higher position than the compression tubing member.

2. The washing machine of claim 1, further comprising a check valve configured to prevent water from returning toward the compression piston, wherein the check valve is in the compression tubing member between the connecting tube member and the opening and closing unit.

3. The washing machine of claim 1, wherein the tub cover comprises:

a spray nozzle connected to the water spraying tube;

a space forming portion or unit configured to form a space for spraying water at an outlet of the spray nozzle; and a water scattering portion or unit on an opposite side of the space forming portion or unit from the spray nozzle.

4. The washing machine of claim 3, wherein the water scattering portion or unit has a hemispherical or shell shape that is cut away in part.

5. The washing machine of claim 4, wherein the space forming portion or unit has a square, rectangular, substantially rectangular or box shape with an open lower part, and includes a wall that slopes downwardly at the side opposite from the spray nozzle.

6. The washing machine of claim 5, wherein a portion of the wall is rounded along an inner periphery of the tub cover.

7. The washing machine of claim 5, wherein a portion of the wall has a shape that expands toward an inner side of the tub cover at opposite sides of the space forming portion or unit.

8. The washing machine of claim 1, wherein the washing machine performs a method comprising:

rotating the inner tub;

introducing water from the outer tub to the compression tubing member;

compressing air in the air storage unit by guiding the water from the compression tubing member to the air storage unit using the compression piston; and spraying water into the inner tub using the compressed air from the air storage unit by opening the opening and closing unit of the water spraying tube.

9. The washing machine of claim 8, wherein said spraying the water into the inner tub comprises contacting the water with a water scattering portion or unit, thereby scattering the water inside the inner tub.

* * * * *